United States Patent [19]

Johne et al.

[11] 4,295,423

[45] Oct. 20, 1981

[54] LIQUID DISTRIBUTING ROLLER ASSEMBLY FOR PRINTING MACHINES

[75] Inventors: Hans Johne, Radebeul; Wolfgang Muller; Arndt Jentzsch, both of Coswig; Günter Schumann, Radebeul, all of German Democratic Rep.

[73] Assignee: VEB Kombinat Polygraph "Werner Lamberz", Leipzig, German Democratic Rep.

[21] Appl. No.: 95,089

[22] Filed: Nov. 16, 1979

Related U.S. Application Data

[63] Continuation-in-part of Ser. No. 87,296, Oct. 22, 1979, abandoned.

[30] Foreign Application Priority Data

Oct. 28, 1978 [DD] German Democratic Rep. ... 208737

[51] Int. Cl.[3] ..... B41F 31/14; B41F 27/16

[52] U.S. Cl. ..... 101/349; 101/DIG. 14

[58] Field of Search ..... 101/DIG. 14, 348, 349, 101/350, 148, 205, 206, 207, 208, 209, 353, 354, 355, 356, 357, 358, 359, 360–362; 74/22 A, 22 R

[56] References Cited

U.S. PATENT DOCUMENTS

| | | | |
|---|---|---|---|
| 378,344 | 2/1888 | Thomson | 101/DIG. 14 |
| 416,820 | 12/1889 | Whitlock | 101/DIG. 14 |
| 2,033,950 | 3/1936 | Morse | 101/DIG. 14 |
| 2,040,331 | 5/1936 | Peyrebrune | 101/348 |
| 2,452,673 | 7/1969 | Gegenheimer et al. | 101/349 |
| 3,389,449 | 6/1968 | Fyfe | 101/348 X |
| 3,625,148 | 12/1971 | Muselik | 101/DIG. 14 |

*Primary Examiner*—J. Reed Fisher

*Attorney, Agent, or Firm*—Michael J. Striker

[57] ABSTRACT

The liquid-distributing roller assembly for printing machines is composed of two opposite pairs of guiding tracks secured to the machine walls. One track supports for rectilinear movement a two-stage transmission gear unit in which one end of the shaft is supported for rotation; the other end of the shaft is supported for rotation and for a rectilinear movement in the opposite track. The shaft supports for rotation and for an axial displacement a liquid distributing roller which at one end is connected to a first spur gear rotatable on one end of the shaft and being in permanent engagement with an elongated transmission gear. The latter is also in permanent engagement with a second spur gear which is connected for joint rotation to the shaft. The other end of the shaft supports a cam which engages a cam follower connected to the distributing roller so that as soon as the latter is rotated an axial reciprocating movement is generated by the cam mechanism.

6 Claims, 5 Drawing Figures

LIQUID DISTRIBUTING ROLLER ASSEMBLY FOR PRINTING MACHINES

CROSS-REFERENCE TO RELATED APPLICATION

This application is a continuation-in-part application of our copending application Ser. No. 087,296, filed Oct. 22, 1979, now abandoned, and entitled DISTRIBUTING ROLLER IN PRINTING PRESSES.

BACKGROUND OF THE INVENTION

This invention relates generally to printing machines having driven rollers, and more particularly to a roller assembly for distributing a liquid such as an inking or dampening agent on the driven rollers in the machine.

In printing machines liquid distributing rollers are known which are rotated by friction with adjoining driven rollers and having gears arranged in the interior of the roller jacket to impart a predetermined axial back and forth movement to the roller. Such known liquid distributing rollers, however, require considerable amount of component parts for the driving and reciprocating gear mechanisms. Moreover, the diameter of the prior art liquid distributing rollers of this type has to be increased in order to accommodate the gear mechanism. Another liquid distributing roller is known which is driven via a spur gear attached to the shaft of the roller and engaging the gear train for the inking rollers. The axial reciprocating movement of the liquid distributing roller is accomplished by means of a two-stage gear mechanism arranged in the interior of the jacket of the distributing roller and cooperating with a reciprocating cam mechanism.

SUMMARY OF THE INVENTION

It is, therefore, a general object of the present invention to overcome the aforementioned disadvantages.

More particularly, it is an object of the invention to provide an improved liquid distributing roller assembly which can be universally employed in any type of printing machine and at an arbitrary point of the roller train of inking or dampening rollers.

Another object of this invention is to provide such an improved liquid distributing roller assembly which is simpler in structure and operation and which can be assembled of a reduced number of component parts.

Still another object of this invention is to provide such an improved distributing roller which operates independently of the driving gears for the inking and dampening rollers.

An additional object of this invention is to provide a liquid distribution roller which can be built with a reduced diameter relative to prior-art rollers and which is capable of operating at an increased rotation rate.

Still another object of this invention is to provide a liquid distributing roller which performs a reciprocating axial movement whereby the rate of oscillations is smaller than its rotational speed.

Furthermore, an object of this invention is to provide a liquid distributing roller which is capable of distributing printing ink or wetting agent in such a manner that it eliminates the retroactive effect of the printing rollers and prevents the formation of stripes and other blemishes which might otherwise result on the print.

In keeping with these objects, and others which will become apparent hereafter, one feature of the invention resides, in a printing machine having a train of driven rollers, in the provision of a liquid distributing roller assembly which comprises two stationary guiding tracks mounted respectively on opposite walls of the machine and inclining toward a selected driven inking or dampening roller, a two-stage transmission gear unit supported for sliding movement on one of the tracks, a main shaft connected at one end to one stage of the gear unit and being supported for a sliding and rotary movement on the other track, a distributing roller supported for rotation and for axial displacement on the main shaft and being coupled to the other stage of the unit to impart its rotary movement to the first stage of the unit, and a cam mechanism connected between the main shaft and the distributing roller to impart a reciprocating axial movement to the latter. Preferably the gear mechanism is arranged on the main shaft between the other track and the end of the distributing roller. The two-stage transmission gear unit includes in one embodiment a housing which supports for rotation an extended spur gear which is in mesh with another gear connected to the main shaft, and with a second gear supported for free rotation on the main shaft and rigidly connected to one end of the liquid distributing roller.

In a modified embodiment of the two-stage transmission gear unit, the first spur gear which is connected to the main shaft as well as the parallel second spur gear connected to the liquid distributing roller are in permanent engagement with an inner gear supported for rotation in the transmission gear housing. The cam mechanism is composed of a cam rigidly connected to the main shaft and remote from the gear housing and of a cam follower rigidly connected to the face of the distributing roller remote from the second spur gear. The inclined guiding tracks for slidably supporting the distributing roller assembly are attached to the walls of the machine frame which also supports for rotation individual inking or dampening rollers. The liquid distributing roller assembly rests on the track and is brought into engagement with the driven inking or dampening rollers by its own weight.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
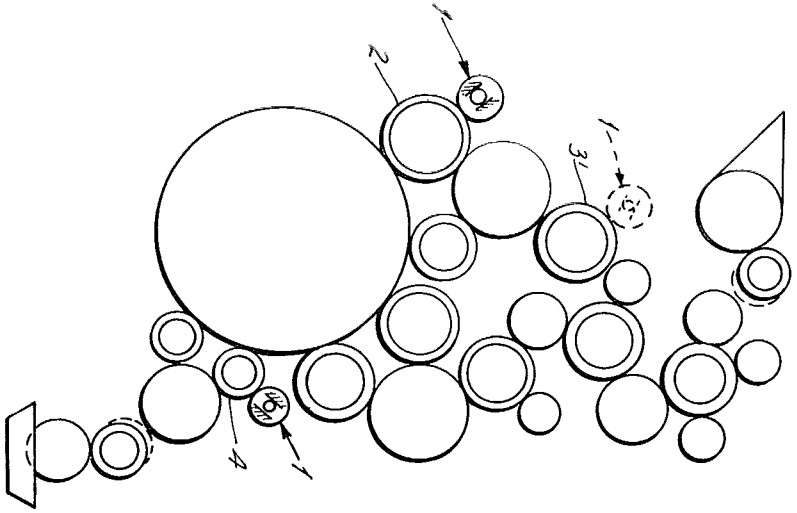
FIG. 1 is a schematic side view of a system of inking and dampening rollers in a printing machine including liquid distributing roller assembly of this invention.

Referring firstly to FIG. 1, there is illustrated schematically a system of driven rollers in a printing machine including inking rollers 2 and 3 and dampening rollers 4. Ink or wetting liquid distributing roller assemblies 1 of this invention are installable for cooperation with an arbitrary inking roller 2 or 3 or with an arbitrary dampening roller 4.

As illustrated in FIGS. 2–5, the liquid distributing roller assembly 1 is composed of a two-stage transmission gear unit 5, a distributing roller 6 and a cam mechanism 7. The roller 6 is connected at one end thereof to a spur gear 19 forming one stage in the transmission gear unit 5 and together with the gear 19 are rotatable and axially displaceable on the shaft 8.

Figure 4:
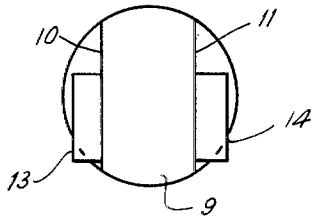
FIG. 4 is a side view on a reduced scale of the liquid distributing roller assembly of FIG. 2 taken along the line IV—IV.
Figure 5:
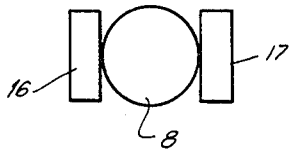
FIG. 5 is another side view of the roller of FIG. 2 taken along the line V—V.

Two parallel strips or guiding tracks 13 and 14 are attached to a side wall 12 of the machine and another pair of parallel tracks 16 and 17 is attached to the opposite wall 15 of the machine frame. The transmission gear housing 9, as illustrated in FIG. 4, has recessed guiding surfaces 10 and 11 which are slidably guided between the inclined tracks 13 and 14 to permit the movement of the jacket of the roller 6 against the assigned driven roller of the machine and at the same time prevents the rotation of the housing 9. One end of the shaft 8 is rotatable in a bearing provided in the housing 9, whereas the other end of the shaft 8 rests on the opposite pair of guiding tracks 16 and 17 which as mentioned above are secured to the opposite wall 15 of the machine frame. The shaft 8 thus can rotate about its axis and at the same time is guided for a rectilinear movement along the inclined guiding track 16 and 17.

Figure 2:
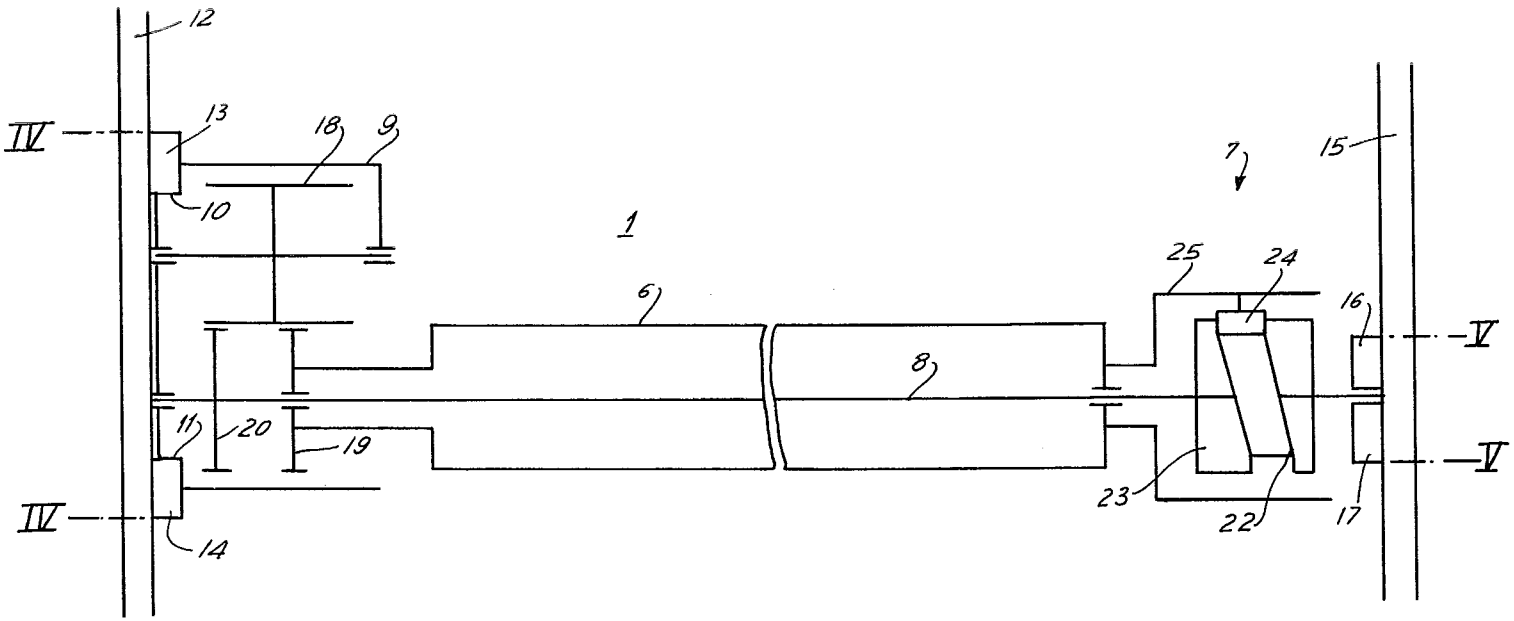
FIG. 2 is a schematic illustration of one embodiment of the liquid distributing roller assembly of this invention.

The reciprocating axial movement of the distributing roller 6 is accomplished by means of the aforementioned transmission gear unit 5 and the cam mechanism 7, the latter being arranged at the end of the shaft 8 apart from the jacket of the roller 6. In the embodiment of the two-stage transmission gear unit 5 as illustrated in FIG. 2, an elongated spur gear 18 is supported for rotation in one section of the housing 9 and is in permanent engagement with the first spur gear 20 which is rigidly connected to the shaft 8. A second spur gear 19 is arranged parallel to the gear 20 and is supported for a rotary movement and for axial displacement on shaft 8.

Figure 3:
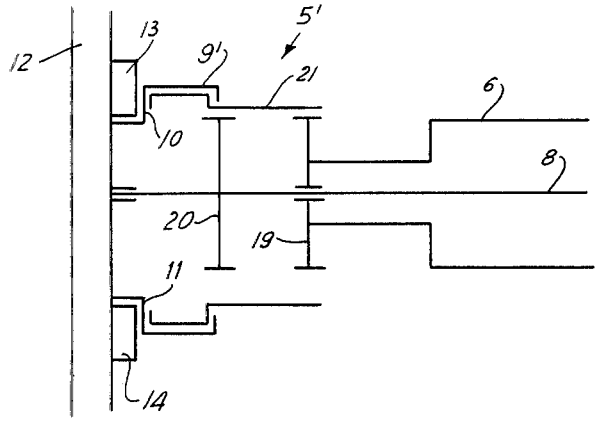
FIG. 3 is a schematic partial view of a modification of the embodiment of FIG. 2.

In a modification of the transmission gear unit 5′ as illustrated in FIG. 3, housing 9′ supports for rotation an extended inner gear 21 which as in the preceding examples, is in a permanent mesh with the first outer gear 20 secured to the shaft 8 and the second outer gear 19 secured to the roller 6.

In both embodiments of the transmission gear units 5 and 5′, the first outer gear 20 and the second outer gear 19 and the corresponding portions of the extended gears 18 and 21 have different numbers of teeth so as to achieve different rotational rates between the roller 6 and the main shaft 8.

The cam mechanism 7 which is arranged at the opposite end of the main shaft 8 includes a cam 23 provided with a reciprocating cam groove 22 which is in engagement with a cam follower 24. The cam follower 24 is mounted on an inner wall of a sleeve 25 which is secured to the corresponding face of the distributing roller 6.

The operation of the liquid distributing roller assembly 1 of this invention is as follows:

The housing 9 and the opposite end of shaft 8 slide on the inclined guiding tracks 14 and 17 into engagement with the assigned inking rollers 2 and 3 or the assigned damping roller 4 and by friction are brought in rotation. The second spur gear 19 drives the extended or double gear 18 or the double gear 21, the latter bringing the first spur gear 20 and thus the shaft 8 into rotation. Due to the different number of teeth between the spur gears 20 and 18, the shaft 8 rotates at a different speed. As a result, the cam follower 24 rotates at a different speed than the cam groove 22 and imparts axial oscillation to the roller 6.

It will be understood that each of the elements described above, or two or more together, may also find a useful application in other types of constructions differing from the types described above.

While the invention has been illustrated and described as embodied in a liquid distributing roller assembly, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A distributing roller assembly for distributing printing ink or a dampening liquid on a driven roller of a printing machine, said assembly comprising two stationary guiding tracks arranged opposite each other; a transmission gear unit formed of a housing supported for sliding movement on one of said tracks, a main shaft having one end thereof journalled in said housing and the other end thereof being supported for sliding movement and for rotation on the other track, a drive output gear rigidly connected to one end portion of said main shaft, a transmission gear journalled in said housing and being in mesh with said drive output gear, and a drive input gear supported for rotation and for axial movement on said one end portion of the main shaft and being in mesh with said transmission gear; a distributing roller supported for rotation and for axial movement on an intermediate portion of said main shaft, one end face of said distributing roller being connected to said input gear to impart rotary movement thereto when said driven roller of the machine is being operated; and an axial cam mechanism arranged between the other end portion of said main shaft and the other end face of said distributing roller to impart thereto via said transmission gear unit a reciprocating axial movement.

2. A roller assembly as defined in claim 1, wherein said transmission gear is an elongated gear supported for rotation in said housing, the drive input and output gears being arranged side by side on said main shaft and each engaging a different section of said elongated transmission gear.

3. The liquid distributing roller assembly as defined in claim 2, wherein said elongated gear is an outer gear.

4. The liquid-distributing roller assembly as defined in claim 2, wherein said elongated gear is an inner gear.

5. The liquid-distributing roller assembly as defined in claim 1, wherein said cam mechanism includes a cam rigidly connected to said shaft apart from said distributing roller and defining a cam groove, a sleeve secured to said distributing roller and supporting on its inner wall a cam follower engaging said cam groove.

6. The liquid-distributing roller assembly as defined in claim 1, wherein said stationary guiding tracks include, respectively, two parallel guiding strips attached to opposite walls of said printing machine and being inclined to the assigned driven roller for guiding said distributing roller.

* * * * *